United States Patent [19]

Switall

[11] 4,198,907

[45] Apr. 22, 1980

[54] SPRAY DAMPENING SYSTEM FOR OFFSET PRINTING WITH PAGE CONTROL ASSEMBLY

[75] Inventor: Thomas G. Switall, Chicago, Ill.

[73] Assignee: Ryco Graphic Manufacturing Inc., Chicago, Ill.

[21] Appl. No.: 945,107

[22] Filed: Sep. 25, 1978

Related U.S. Application Data

[63] Continuation of Ser. No. 794,257, May 5, 1977, abandoned.

[51] Int. Cl.[2] ..... B41F 7/30; B41L 25/06

[52] U.S. Cl. ..... 101/147; 101/366

[58] Field of Search ..... 101/147, 148, 365, 366; 239/93, 99, 556, 557, 558, 582, 551, 562; 118/7, 8, 313, 314, 315

[56] References Cited

U.S. PATENT DOCUMENTS

| | | | |
|---|---|---|---|
| 2,448,226 | 8/1948 | Marsden | 101/147 |
| 3,651,756 | 3/1972 | Smith, Jr. | 101/147 |
| 3,949,668 | 4/1976 | Smith, Jr. | 101/148 |

*Primary Examiner*—J. Reed Fisher
*Attorney, Agent, or Firm*—Lee & Smith

[57] ABSTRACT

The disclosed system controls, through novel pressure and valving adjustment mechanisms, the application of dampening fluid to the ink roll or offset plate on the plate cylinder of an offset printing press. The dampening fluid passes through a pressure compensator which adjusts the fluid pressure in response to changes in the speed of the press. The fluid at the adjusted pressure is then directed to a spray bar, where it is discharged through a plurality of nozzles. The fluid is directed to the spray bar by a multiple valve, page control assembly. In the page control assembly fluid from a common manifold is discharged through a plurality of dual control valves to respective nozzles. Closure elements for the respective valves are operated by air pistons. A plurality of needle elements for the respective valves are axially adjusted by a common manual control so that adjusting the manual control adjusts the amount of fluid from one segment of the spray bar, preferably corresponding to a full page.

13 Claims, 6 Drawing Figures

SPRAY DAMPENING SYSTEM FOR OFFSET PRINTING WITH PAGE CONTROL ASSEMBLY

CROSS REFERENCE TO RELATED APPLICATION

This is a continuation, of application Ser. No. 794,257, filed May 5, 1977, now abandoned.

This application incorporates by reference copending application Ser. No. 722,623 filed Sept. 13, 1976 by Thomas G. Switall entitled "Spray Dampening System for Offset Printing," now U.S. Pat. No. 4,064,081, which is a continuation-in-part of application Ser. No. 604,016, filed Aug. 12, 1975, now abandoned.

SUMMARY OF THE INVENTION

The present invention is an improvement on the type of apparatus shown in FIGS. 8–12 of the referenced application in which a threaded knob positions a single needle element within a piston-operated valve closure sleeve.

The present invention enables a plurality of needle elements to be controlled simultaneously as well as the closure sleeves. In the embodiment discussed below, parallel air cylinders are spaced radially about a central axis. Each cylinder receives a piston-like valve closure sleeve member through which a slidable needle element extends. A screw drive arrangement positions a common drive member to which the ends of the needle elements are attached so that the drive member moves all of the needle elements simultaneously inward or outward. Each air cylinder is pressurized through ports formed by the intersection of the cylinder and a single annular chamber coaxial with the central axis. An air valve and additional ductwork supply air to the annular chamber.

DESCRIPTION OF THE PREFERRED EMBODIMENT

Figure 1:
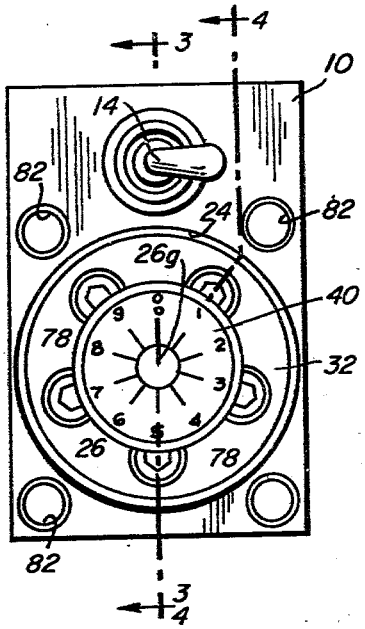
FIG. 1 is a front view of the page control assembly.

Reference numbers and figure numbers refer to the drawings in the present application rather than the referenced application unless otherwise indicated. FIGS. 1–4 illustrate a specific design for a page control assembly for adjusting the flow of dampening fluid to five spray nozzles (14, as shown in FIG. 12 of the referenced application). The page control assembly described in the present application takes the place of the fluid manifold 220 and air cylinder housing 232 serving five fluid lines 238 as shown in FIG. 8 of the referenced application. In the embodiment according to the present invention, the five fluid lines remain; however, the valves for adjusting the flow from the fluid manifold to the lines are arranged in a circular array instead of a row, and the five knobs 262*a* shown in FIG. 8 of the referenced application are replaced by a single knob controlling all five needle valves.

With reference to the drawing of the present application, a rectangular block 10, preferably of brass, is provided with an upper central bore 12 which receives an air toggle switch 14 of conventional design. A coaxial port 16 is formed in the bottom of the bore 12 at the rear of block 10 to accommodate a fitting for an air supply duct, for example, corresponding to line 274 in FIG. 12 of the referenced application. The block 10 is furnished with a central bore 18 which is in communication with the toggle switch 14 via a duct 20. The back portion of the bore 18 has a short coaxial bore 22 of reduced diameter. In the front of the block 10, there is a relatively large circular cavity 24 coaxial with the central bores 18 and 22.

The central bores 18 and 22 receive a tightly fitting solid steel shaft 26 which is keyed to the block to prevent rotation. As viewed in FIG. 4, the shaft 26 has an externally threaded section **26*a* which extends within and leftward of the cavity 24. Within the bore 18, the shaft 26 has an inner portion 26*b* grooved to receive an O-ring 28, having a diameter closely matching the diameter of the central bore 18. The portion 26*b* is followed by a portion 26*c* of slightly reduced diameter and another portion 26*d* with the same diameter as portion 26*b*. Shaft 26 terminates in an end portion 26*e* of the same diameter as the diameter of the short bore 22 with a coaxial threaded end bore 26*f***.

A cylindrical steel screw drive fitting 30 is threaded onto the solid end **26*a* of the shaft. Freely mounted on the screw drive fitting is a steel, puck-shaped needle drive member 32 having an outer diameter closely matching the diameter of the circular cavity 24 and fitted with an O-ring seal 34. A guide pin 32*a* is provided in corresponding aligned bores in the block 10 and needle drive member 32. The needle drive member 32 does not rotate but is trapped between split rings 36 and 38 received in corresponding ring grooves on the screw drive fitting 30. A knob 40 is fixed to the end of the screw drive fitting 30 by a set screw 42. When the member 32 is all the way in, the end of the stationary shaft 26 extends through a central aperture in the knob 40 and has a saw-cut 26*g*** forming a radial line on the end to serve as a pointer as shown in FIG. 1.

Equally radially spaced about the central bore 18 are five bores 44, like the chamber of a revolver, forming five air cylinders parallel to the axis of the central bore 18 at the same axial location. Each air cylinder 44 terminates in a short throughbore 46 forming a shoulder against which a thin washer-shaped plastic bushing 48 is press-fit.

Figure 3:
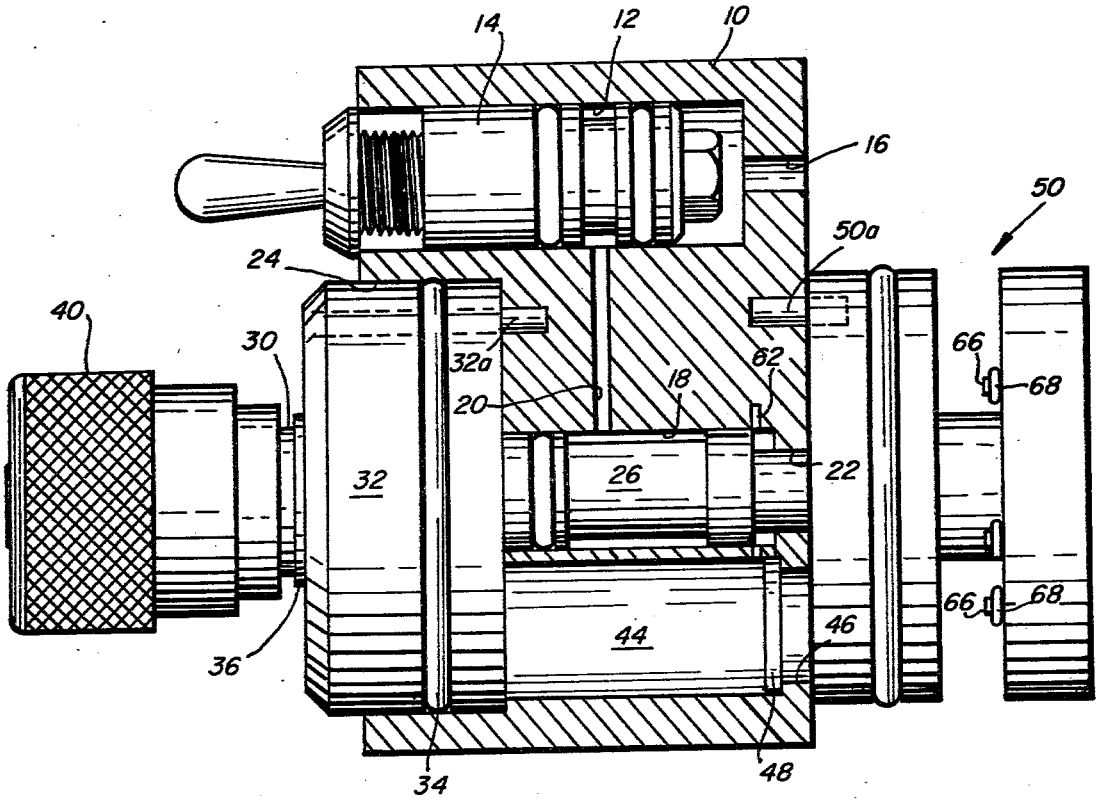
FIG. 3 is a sectional view of the page control assembly taken along lines 3—3 of FIG. 1 showing parts of the apparatus in elevation with the piston assemblies absent from the air cylinders.
Figure 4:
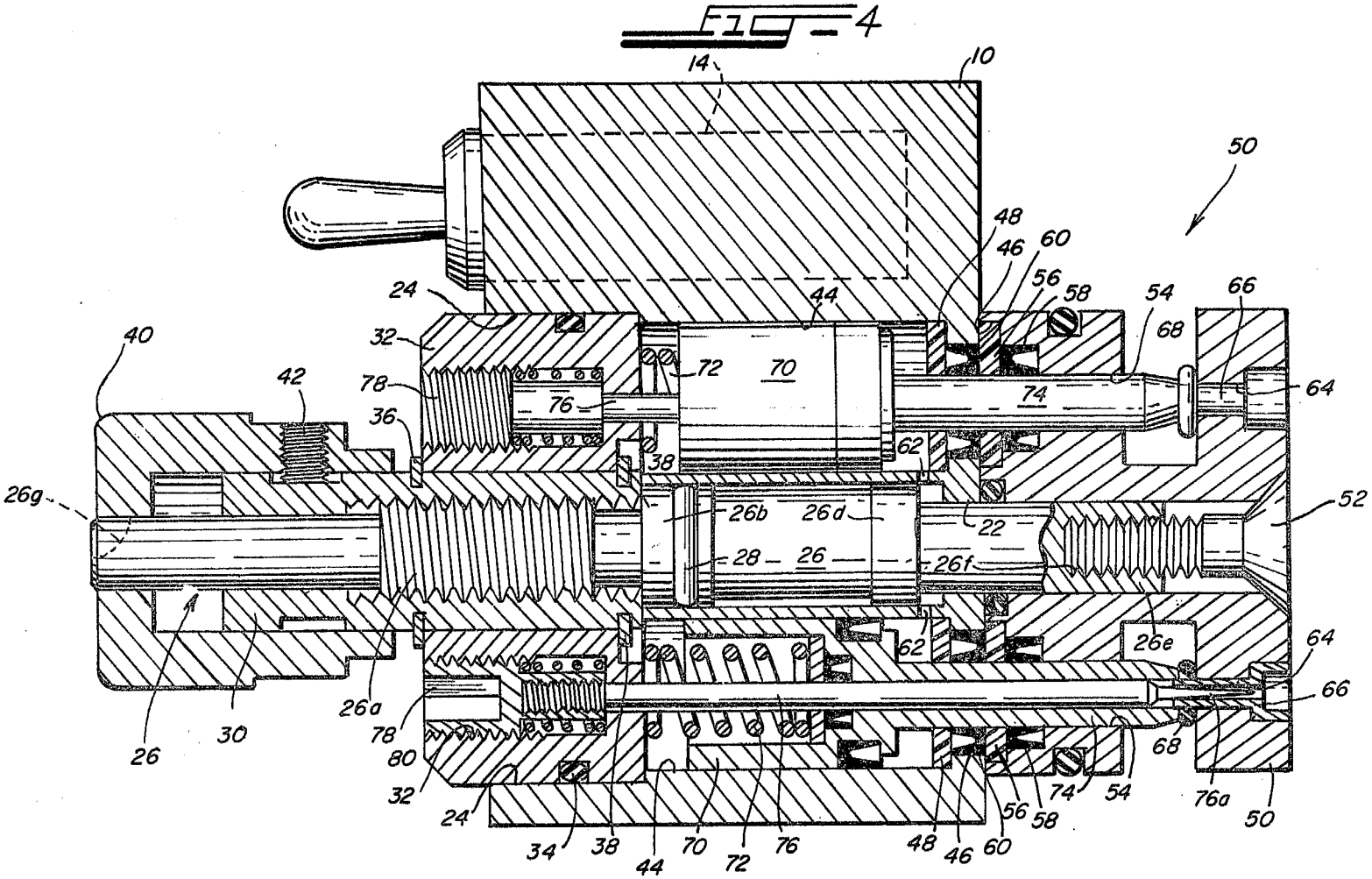
FIG. 4 is a detailed sectional view of the page control assembly of FIG. 1 taken along lines 4—4 of FIG. 1 with certain portions in elevation and with the closure sleeves and needle elements at their furthest rightward excursion as viewed in FIG. 4.

On the right-hand end **26*e* of the shaft as viewed in FIGS. 3 and 4, a spool-shaped steel manifold member 50 is coaxially received on the shaft end 26*e* and attached thereto with machine screw 52. The manifold member 50 is secured against rotation by guide pin 50*a*. The portion of the manifold member 50 adjacent to the block 10 has five bores 54 coaxial with the respective air cylinders 44 in the block 10. The bore 54** is counterbored in two steps to receive another washer-like plastic bushing 56 between the manifold member 50 and the block 10 and a seal ring 58 between the bushing 56 and the manifold member 50. Another seal ring 60 is positioned between the bushings in the bore 46.

An annular groove 62 is formed in the block 10 coaxially in the interior surface of the central bore 18 at the end adjacent to the throughbore 22. This groove 62 is of sufficient radius to intersect each one of the five air cylinders 44 to form a slotted window near one end of each one of the cylinders. This window provided by the groove 62 communicates with the interior of the bore 18 and, via the duct 20, with the air toggle switch 14.

The outer disc-shaped element of the manifold member 50 has five counter bored apertures 64 formed coaxially with the respective bores 54 and air cylinders 44. These apertures 64 receive cylindrical valve seat members 66 each of which has an end or orifice which protrudes into the annular space between the two much larger diameter discs of the manifold member 50. The protruding end of each valve seat 66 is fitted with an O-ring 68.

Each air cylinder 44 receives a corresponding piston assembly, as shown in FIG. 4, comprising a hollow piston 70 having an outer diameter closely matching the diameter of the air cylinder 44. In each cylinder a compression spring 72 has one end bearing against the flat inner surface of the needle drive member 32 and the other end bearing against the inside of the piston 70 and urging it rightward as viewed in FIG. 4. The piston member 70 is integrally formed with an elongated valve closure sleeve member 74 extending through the bushing 48, seal 60 inside the throughbore 46 and on through the adjacent disc-shaped portion of the manifold member 50 passing through the bushing 56, seal ring 58 and bore 54. Each sleeve member terminates in a beveled end in the annular space between the two disc-shaped portions of the manifold member 50. The inner diameter of the nose of the closure sleeve member of each piston is large enough to receive the protruding end of the valve seat 66 so that the nose of each closure member 74 comes into sealing contact with the respective O-ring 68 when the piston 70 is at its farthest rightward excursion within the cylinder. Each piston 70 carries suitable seal rings to make an airtight chamber within each air cylinder 44 to the right of the piston 70.

A needle element 76 extends completely through each piston assembly 70 and its closure sleeve member 74. Each of the five needle elements 76 comprises an elongated shaft having an end with a reduced diameter terminating in a tapered pinpoint coaxial with the axis of the respective valve seat 66. The diameter of the tapered point 76*a* increases to beyond the inner diameter of the valve seat 66. The opposite end of each needle element 76 is threaded into a set screw 78 which in turn is received in a threaded bore 80 in the needle drive member 32. A compression spring is arranged in each bore 80 to help retain the position of the set screw 78.

Figure 2:
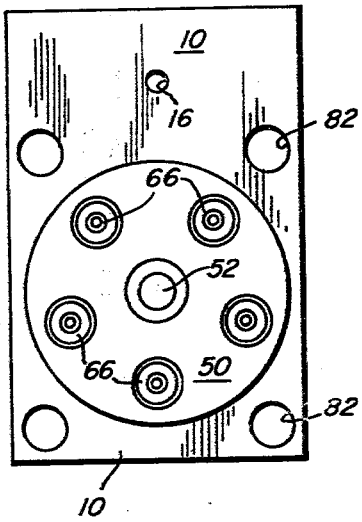
FIG. 2 is a rear view of the page control assembly of FIG. 1, showing the connections for the fluid lines.

The annular interior space of the manifold member 50 into which the ends of the closure sleeve members 74 and valve seat 66 protrude, forms a fluid manifold. Through-holes 82, shown in FIGS. 1 and 2, are supplied for bolting the page control assembly to a suitable fluid manifold assembly supplying fluid via the valve seat members 66 to the spray nozzles of the spray bar. Several page control assemblies may share a larger fluid manifold assembly. The larger ends of the valve seat members 66 flush with the end surface of the manifold member 50 are designed to receive fittings for attachment to respective fluid lines which are connected to respective spray nozzles (14, for example, in FIG. 12 of the referenced application).

Figure 5:
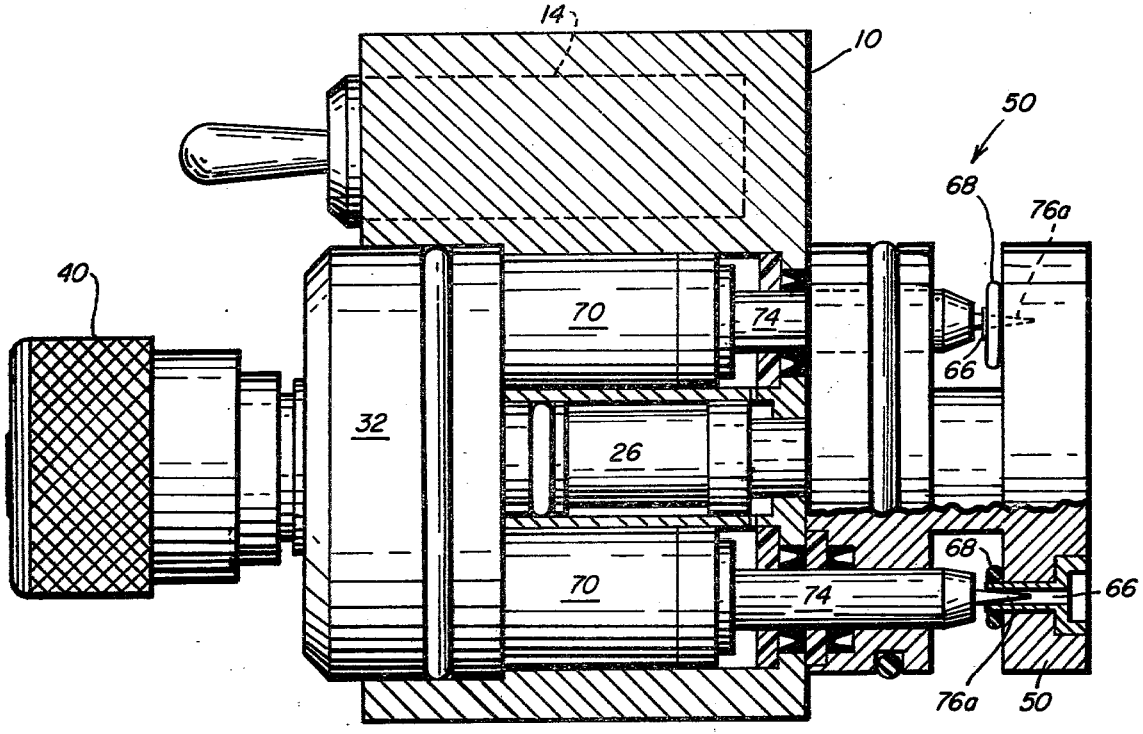
FIG. 5 is a sectional view similar to that of FIG. 4 illustrating leftward retraction of the valve closure sleeves.
Figure 6:
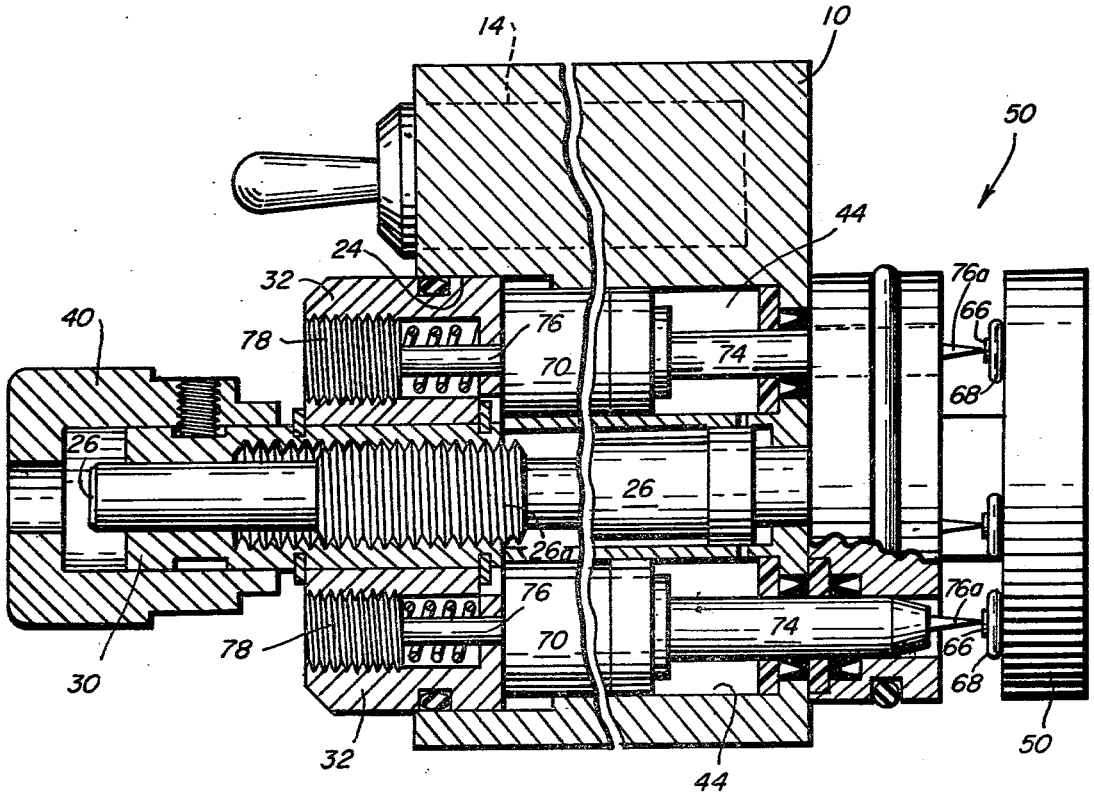
FIG. 6 is a sectional view similar to that of FIGS. 4 and 5 showing both the valve closure sleeves and the needle elements in their furthest leftward excursion.

In operation, the fluid in the annular manifold of the member 50 is prevented from flowing to the nozzles when the nose of each closure sleeve 74 rests firmly against the respective O-ring 68 by action of the spring 72 in the air cylinder 44. When the toggle switch 14 is actuated, each piston 70 is forced back by air pressure against the needle drive member 32 thus retracting the valve closure sleeves and freeing the entrance to each respective valve seat 66, as shown in FIG. 5. However, in FIG. 5 the needle drive member 32 is all the way in, that is, the drive member 32 has bottomed out in the cavity 24. Thus the tapered point 76*a* of each needle element is inserted well into each respective valve seat 66 thus greatly restricting the flow of dampening fluid through the valve orifice. To increase the flow, the knob 40 is rotated counterclockwise to withdraw the needle drive member 32 with a screw drive action. As the needle drive member is backed out of the cavity 24, as shown in FIG. 6, the member 32 retracts the five needle elements 76. The tips 76*a* are thus withdrawn from the valve seat 66 permitting a maximum flow of dampening fluid through the valve seat member 66. Each needle element 76 can be further retracted by applying an Allen wrench to the corresponding set screw 78 carried by the drive member 32.

The design of the page control assembly makes it possible to manually adjust the amount of spray dampening fluid reaching the press from a plurality of adjacent nozzles covering the width of one page. The importance of this feature lies in the assurance that the entire page will be of uniform quality rather than having portions printed in the presence of too little or too much dampening fluid. The assembly allows single knob control of a plurality of needle valves each having a respective piston-operated valve closure device. The arrangement of these elements in the preferred embodiment results in an extremely compact and smoothly operating mechanism retaining the capability of simple independent adjustment of each needle valve.

Although it is not the preferred embodiment, it is possible for an arrangement of the type described in the present application to be adapted for automatic needle valve adjustment in a manner which will be apparent to those skilled in the art from FIGS. 11 and 12 of the referenced application.

The foregoing description of the apparatus has been given as an example of the presently preferred embodiment. Various modifications of the size, arrangement, number, structure and material of the various components can be made without departing from the principle of the invention disclosed herein or the scope of the following claims.

I claim:

1. In a spray dampening system for delivery of a dampening fluid to a printing press; a plurality of spray nozzles; fluid delivery means for delivering dampening fluid to said nozzles, said fluid delivery means including fluid regulating means comprising a plurality of valves each associated with at least one of said nozzles, each of the said valves including a valve member movable toward and away from its closed position to open and close each valve, each of said valve members carrying a piston, valve operating means for selectively moving each of said valve members toward and away from its closed position, said valve operating means including a resilient member urging each of said valve members toward its closed position and means for selectively directing air under pressure against said valve member pistons to effect movement of said valve member away from their closed position against the resistance of said resillient member, and adjustable valve restriction means for restricting the fluid passage through said valve when said valve is open and selectively movable to adjust the degree of restriction of the fluid passage through said valve, whereby the flow of dampening fluid through each valve to the associated nozzle may be regulated.

2. The apparatus of claim 1 wherein said means for selectively directing air under pressure against said valve member pistons includes at least one manifold in fluid communication with the valve member pistons of several of said valves, and manifold control means for selectively pressurizing said manifold, whereby said several valves may be opened simultaneously.

3. The apparatus of claim 2, wherein there are provided a plurality of manifolds, each in fluid communication with the valve member pistons of a respective set of valves, and said manifold control means includes a separate pressure switch for each manifold.

4. In a spray dampening system having a plurality of spray nozzles and a plurality of valves for controlling the delivery of dampening fluid to respective spray nozzles, each valve providing a variable degree of restriction, the improvement comprising (a) a single control means for manually adjusting in unison all of the adjustable valve elements in the valve for the group of respective adjustment spray nozzles to vary the degree of restriction, each said valve including an inlet orifice in communication with a source of pressurized dampening fluid, (b) said single control means having a common drive member attached to each of said valve elements for said group of spray nozzles, and further having means to adjust said common drive member for positioning each of said valve elements between a first location of maximum restriction and a second location of minimum restriction, (c) each adjustable valve element including a shaft having a tapered tip axially introduceable into a respective orifice of said valve, (d) a separate valve closure member for each of said valves for controlling fluid flow through said valve, each of said closure members being operable by control means independent of said single control means, and (e) each said valve closure member including a closure element axially slideable upon the shaft of each of said adjustable valve elements for directly opening and closing the orifice of each of said valves in said group independently of the position of said adjustable valve element.

5. The system of claim 4 including common control means for opening and closing all of the valve closure members in said group of valves.

6. The system of claim 4, wherein the valves in said group are arranged in a circular array about a central axis.

7. The system of claim 6, in which the shafts of said adjustable valve elements are parallel to said central axis and each shaft for said group of valves has an end opposite said tip which is attached to said common drive member, and in which said means to adjust the common drive member comprises means for moving the tips of said adjustable elements toward or away from the respective orifices in said group of valves.

8. The system of claim 7, wherein the means for moving the tips includes a screw drive mechanism having a fixed shaft and a rotatable drive fitting threadedly engaging said fixed shaft, said rotatable drive fitting being movable axially along said shaft when said drive fitting is rotated, and means for preventing relative movement between said rotatable drive fitting and said drive member.

9. The system of claim 7, wherein said drive member has means for separately adjusting the axial position of each adjustable valve element.

10. The system of claim 7 in which each valve closure member includes means for advancing and retracting all of the closure elements for the valves in said group simultaneously.

11. The system of claim 10, wherein said means for advancing and retracting the closure elements includes a respective air piston connected to the end of each of the closure elements opposite from the end which engages the orifice of the respective valve;

means defining a plurality of respective air cylinders for said pistons;

means for normally urging said closure elements in a direction to maintain the respective orifice in a closed condition; and means for exhausting the interiors of said air cylinders simultaneously or for pressurizing the interiors of said air cylinders simultaneously to maintain closed or to open the respective valves.

12. The system of claim 11, wherein said means for exhausting or pressurizing includes an air toggle switch and means for communicating the interior of each air cylinder with said toggle switch.

13. The system of claim 11, wherein said air cylinders extend parallel to the central axis and are radially spaced about said central axis.

* * * * *